US010190602B2

(12) United States Patent
Hsin et al.

(10) Patent No.: US 10,190,602 B2
(45) Date of Patent: Jan. 29, 2019

(54) COOLING FAN WITH MOVING BAFFLE

(71) Applicant: DELTA ELECTRONICS, INC., Taoyuan County (TW)

(72) Inventors: Han-Tsung Hsin, Taoyuan County (TW); Shih-Hao Feng, Taoyuan County (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 116 days.

(21) Appl. No.: 14/840,390

(22) Filed: Aug. 31, 2015

(65) Prior Publication Data

US 2017/0023024 A1 Jan. 26, 2017

(30) Foreign Application Priority Data

Jul. 21, 2015 (CN) ..... 2015 1 0430061

(51) Int. Cl.

| | |
|---|---|
| ***F04D 29/70*** | (2006.01) |
| ***F04D 17/16*** | (2006.01) |
| ***F04D 29/42*** | (2006.01) |
| ***F04D 29/28*** | (2006.01) |
| ***F04D 29/053*** | (2006.01) |

(52) U.S. Cl.

CPC ..... *F04D 29/701* (2013.01); *F04D 17/16* (2013.01); *F04D 29/053* (2013.01); *F04D 29/281* (2013.01); *F04D 29/4226* (2013.01)

(58) Field of Classification Search

CPC ... B01D 45/16; G06F 1/20; F01D 1/02; F04D 29/701; F04D 17/16; F04D 29/4226; F04D 29/70; F04D 29/053; F04D 29/281

See application file for complete search history.

(56) References Cited

U.S. PATENT DOCUMENTS 9,845,805 B2 * 12/2017 Bhutani ..... F04D 25/0613
2010/0283254 A1 * 11/2010 Richter ..... F03D 3/067 290/55
2012/0288384 A1 * 11/2012 Chou ..... F04D 17/162 417/410.1
2013/0232678 A1 * 9/2013 Han ..... E03D 1/142 4/325

FOREIGN PATENT DOCUMENTS

CN 102418705 A * 9/2010 ..... F04D 25/08

* cited by examiner

*Primary Examiner* — Dwayne J White
*Assistant Examiner* — Justin A Pruitt
(74) *Attorney, Agent, or Firm* — Hauptman Ham, LLP

(57) ABSTRACT

A cooling fan includes a frame base including a frame wall, a bottom plate and a cover plate for enclosing and defining a containing space. The vane wheel is installed in the containing space and provided for producing a cooling forced airflow when the vane wheel is in a forward rotation status and forming a strong wind area, and producing a dust discharging forced airflow when the vane wheel is in a reverse rotation status. The moving baffle module is rotably installed in the strong wind area, and the frame base includes a dust discharging opening configured to be corresponsive to the periphery of the strong wind area, and the dust discharging forced airflow is affected by the moving baffle module to discharge dust from the dust discharging opening to the outside.

9 Claims, 8 Drawing Sheets

COOLING FAN WITH MOVING BAFFLE

FIELD OF THE INVENTION

The technical field relates to a cooling fan, more particularly to the cooling fan with a dust discharging function.

BACKGROUND OF THE INVENTION

In general, a cooling fan is provided for producing a forced convection to dissipate heat generated in the operation of an electronic product and lower the temperature during the operation of the electronic product. In recent years, notebook (NB) computers tend to be designed with a small thickness and the internal space of the notebook computers is reduced to an extent that already affects the internal space available for installing the cooling fan. What is more, present cooling fans require increasingly higher performance. In a long time of use, the airflow of the cooling fans is introduced through the air inlet continuously. The airflow is usually mixed with tiny dusts and cotton fibers which will be accumulated on the fins and inside the fan, and such accumulated dust may affect the internal flow channel and the input and output of air. As a result, the cooling effect of the cooling fan drops significantly.

The accumulated dust seals the interior of the fan. It is very difficult to clear the dust, and the dust accumulated in the fan affects the overall air input and output of the cooling fan. Therefore, the heat dissipating effect of the cooling fan is reduced significantly, and the service life of the cooling fan is shortened. Therefore, it is a main subject for related manufacturers to design a cooling fan with a dust discharging function that can maintain a high performance of the cooling fan and extend the service life of the fan.

In view of the aforementioned problems of the prior art, the inventor of this disclosure based on years of experience in the industry to conduct extensive researches and experiments and finally provided a feasible solution to overcome the problems of the prior art.

SUMMARY OF THE INVENTION

It is a primary objective of this disclosure to provide a cooling fan with a moving baffle for discharging dust in the frame base to maintain the heat dissipating efficiency of the cooling fan.

To achieve the aforementioned objective, this disclosure provides a cooling fan with a moving baffle for discharging dust in the cooling fan, and the cooling fan comprises a frame base, a vane wheel and a moving baffle module. The frame base comprises a frame wall, and a bottom plate and a cover plate combined with upper and lower sides of the frame wall respectively, and a containing space enclosed and formed by the frame wall, the bottom plate and the cover plate. The vane wheel is installed in the containing space, and the vane wheel in a forward rotation status produces a cooling forced airflow and forms a strong wind area, and the vane wheel in a reverse rotation status produces a dust discharging forced airflow. The moving baffle module is rotably installed in the strong wind area, wherein the frame base has a dust discharging opening configured to be corresponsive to the periphery of the strong wind area, and the dust discharging forced airflow is affected by the moving baffle module to discharge dust from the dust discharging opening to the outside.

Compared with the prior art, the cooling fan with a moving baffle of this disclosure has the vane wheel and the moving baffle module installed in the frame base, and the vane wheel in the forward rotation status produces a cooling forced airflow and forms a strong wind area, and the vane wheel in the reverse rotation status produces a dust discharging forced airflow. In addition, the moving baffle module is installed in the strong wind area which is formed by rotating the vane wheel, and the frame base has a dust discharging opening configured to be corresponsive to the periphery of the strong wind area. The flow field of the dust discharging forced airflow is affected by the moving baffle module to discharge dust from the dust discharging opening to the outside, so as to discharge the dust in the frame base to maintain the heat dissipating efficiency of the cooling fan and improve the service life of the cooling fan.

DESCRIPTION OF THE PREFERRED EMBODIMENTS

The technical contents of this disclosure will become apparent with the detailed description of preferred embodiments accompanied with the illustration of related drawings as follows. It is intended that the embodiments and figures disclosed herein are to be considered illustrative rather than restrictive.

Figure 1:
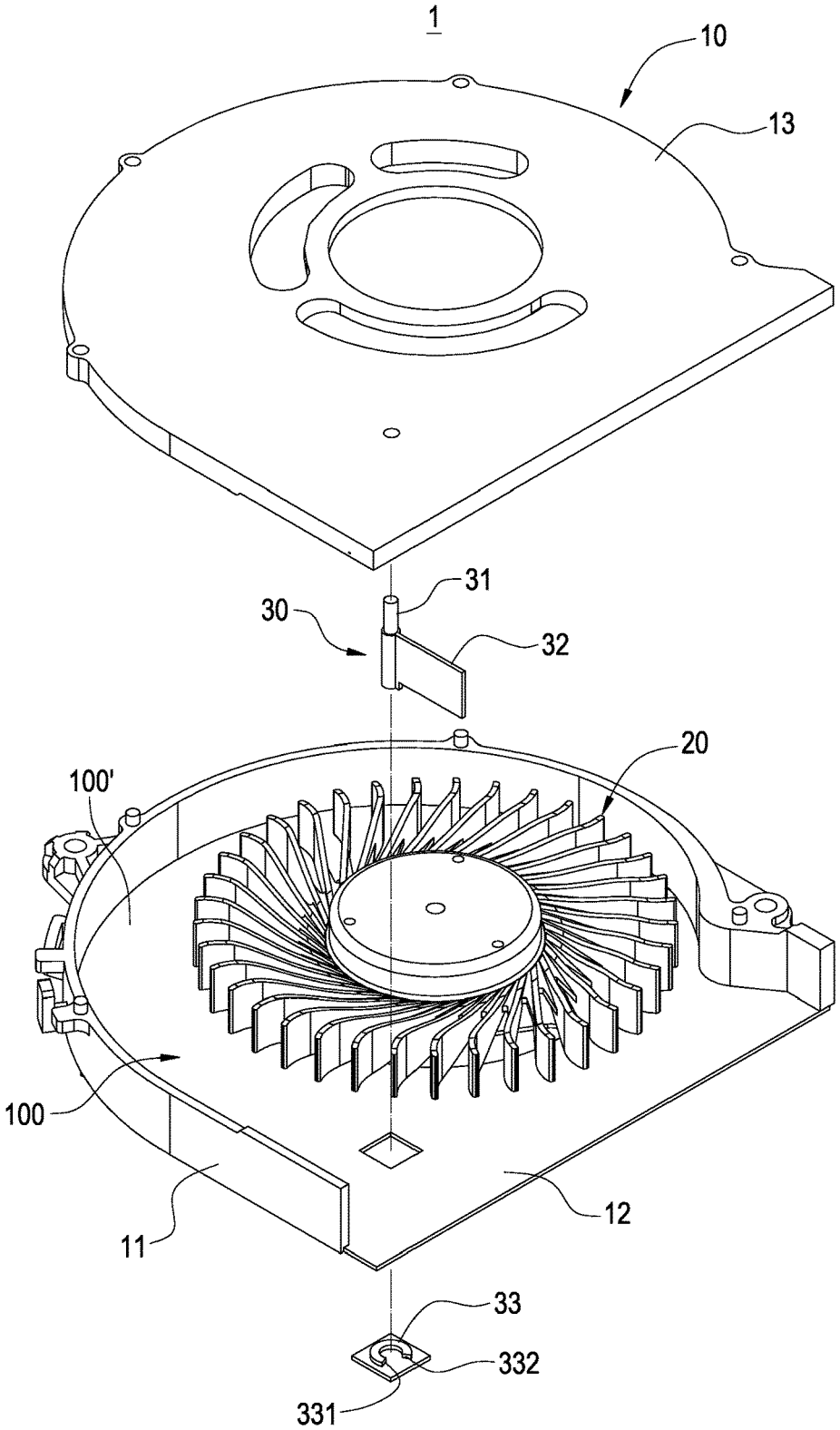
FIG. 1 is an exploded view of a cooling fan with a moving baffle in accordance with this disclosure.
Figure 2:
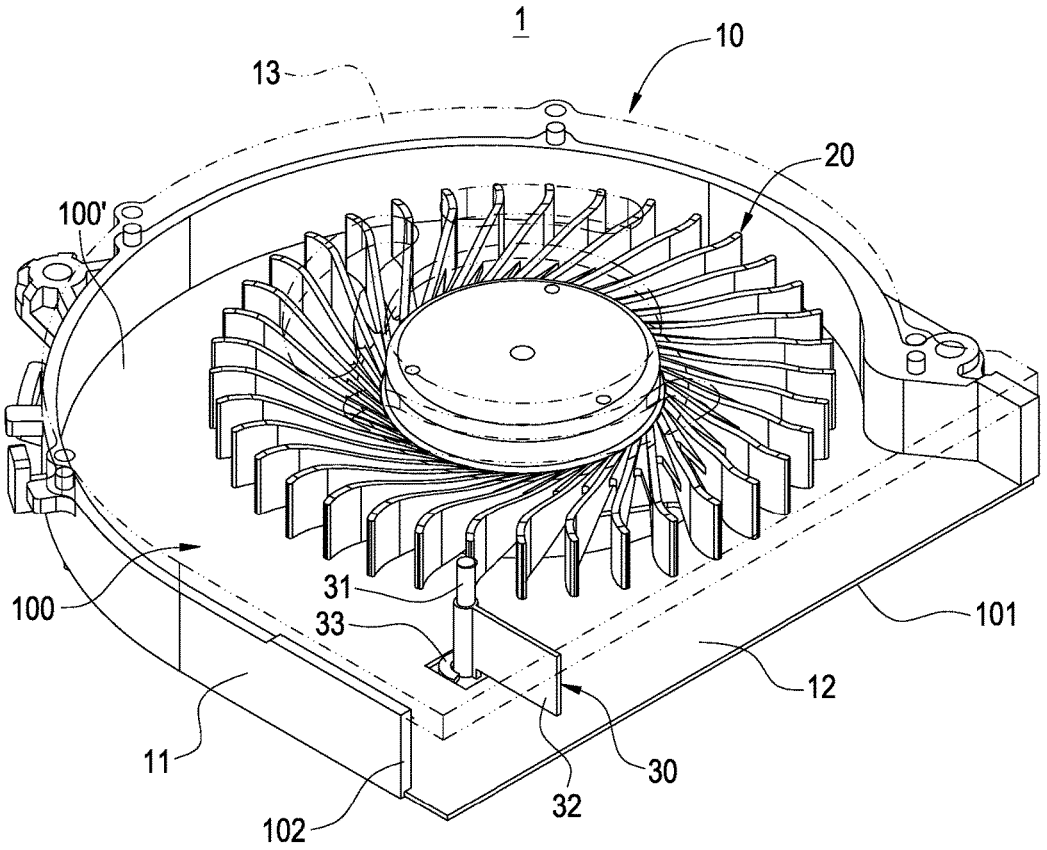
FIG. 2 is a perspective view of a cooling fan with a moving baffle in accordance with this disclosure.
Figure 3:
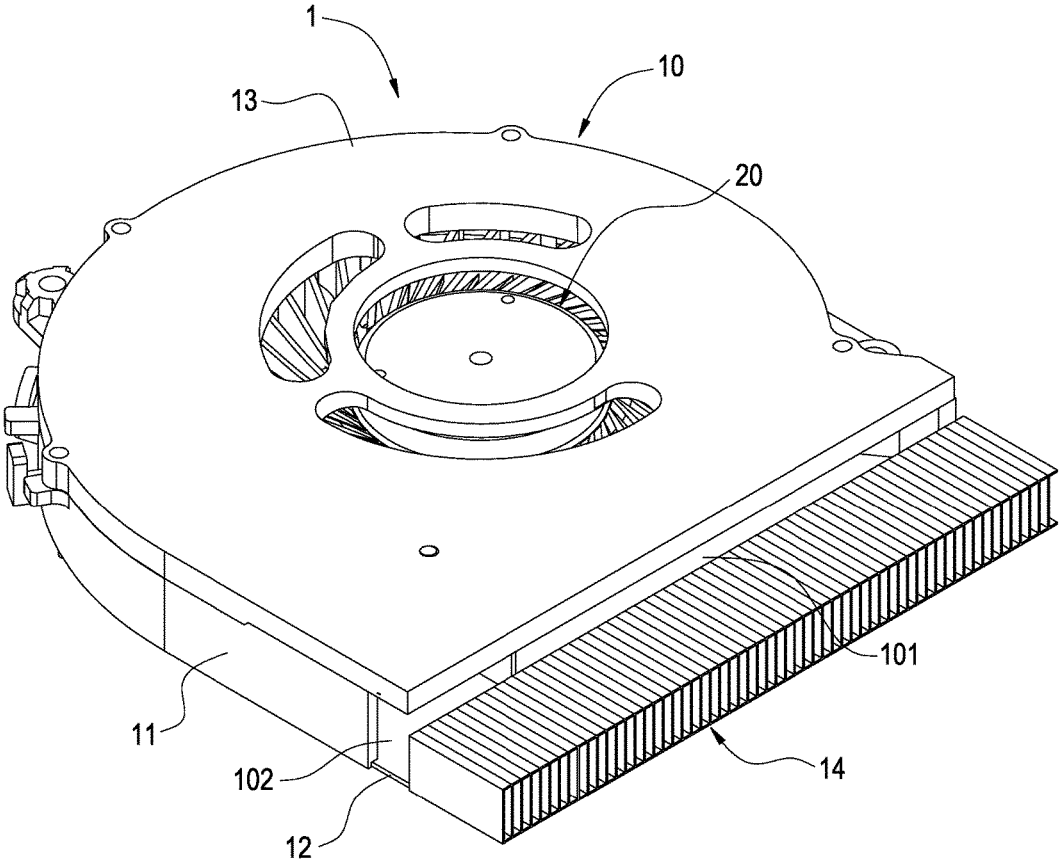
FIG. 3 is a perspective view of a cooling fan with a moving baffle combined with a fin module in accordance with this disclosure.

With reference to FIGS. 1 to 3 for an exploded view and a perspective view of a cooling fan with a moving baffle and a perspective view of the cooling fan combined with a fin module in accordance with this disclosure respectively, the cooling fan with a moving baffle 1 for discharging dust in the cooling fan. The cooling fan 1 comprises a frame base 10, a vane wheel 20, and a moving baffle module 30. The vane wheel 20 and the moving baffle module 30 are installed in the frame base 10, so as to form the cooling fan 1.

The frame base 10 includes a frame wall 11, and a bottom plate 12 and a cover plate 13 combined with upper and lower sides of the frame wall 11 respectively. A containing space 100 is enclosed and formed by the frame wall 11, the bottom plate 12 and the cover plate 13. In FIG. 3, the cooling fan 1 of this disclosure further comprises a fin module 14. An air outlet 101 is enclosed and formed by the frame wall 11, the bottom plate 12 and the cover plate 13 and communicated with the containing space 100, and the fin module 14 is installed at the air outlet 101. In addition, the frame base 10 further includes a dust discharging opening 102, and the dust discharging opening 102 of this embodiment is formed on the frame wall 11 and disposed proximate to the air outlet 101. The detailed configuration of the dust discharging opening 102 will be described later.

The vane wheel 20 is installed in the containing space 100 and forms a flow channel 100' with the frame wall 11 in the containing space 100, and the forced airflow produced by the vane wheel 20 flows through the flow channel 100' and discharges to the outside.

In addition, the moving baffle module 30 is rotably installed in the flow channel 100'. The moving baffle module 30 comprises a shaft 31, and a baffle 32 axially installed to the shaft 31. The baffle 32 is driven by the forced airflow to rotate with respect to the shaft 31. In an embodiment of this disclosure, the moving baffle module 30 further comprises a limit plate 33 installed to a side of the baffle 32. The limit plate 33 has a first lateral side 331 and a second lateral side 332 for limiting the rotating angle of the baffle 32. In this embodiment, the limit plate 33 is a C-shaped ring, and the limit plate 33 is combined with the shaft 31 and the bottom of the baffle 32.

Figure 4:
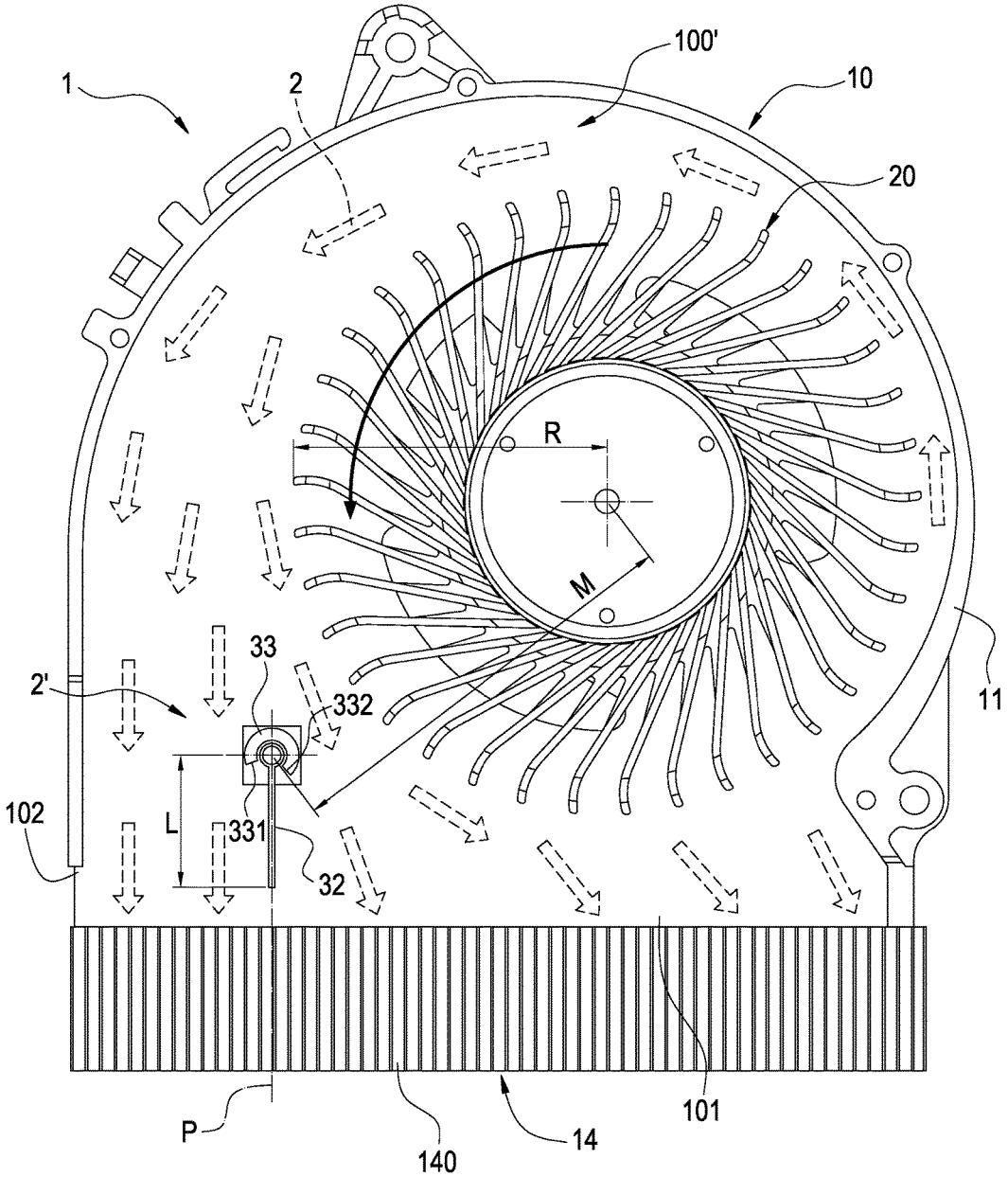
FIG. 4 is a schematic view of a cooling fan with a moving baffle in a forward rotation status in accordance with this disclosure.
Figure 5:
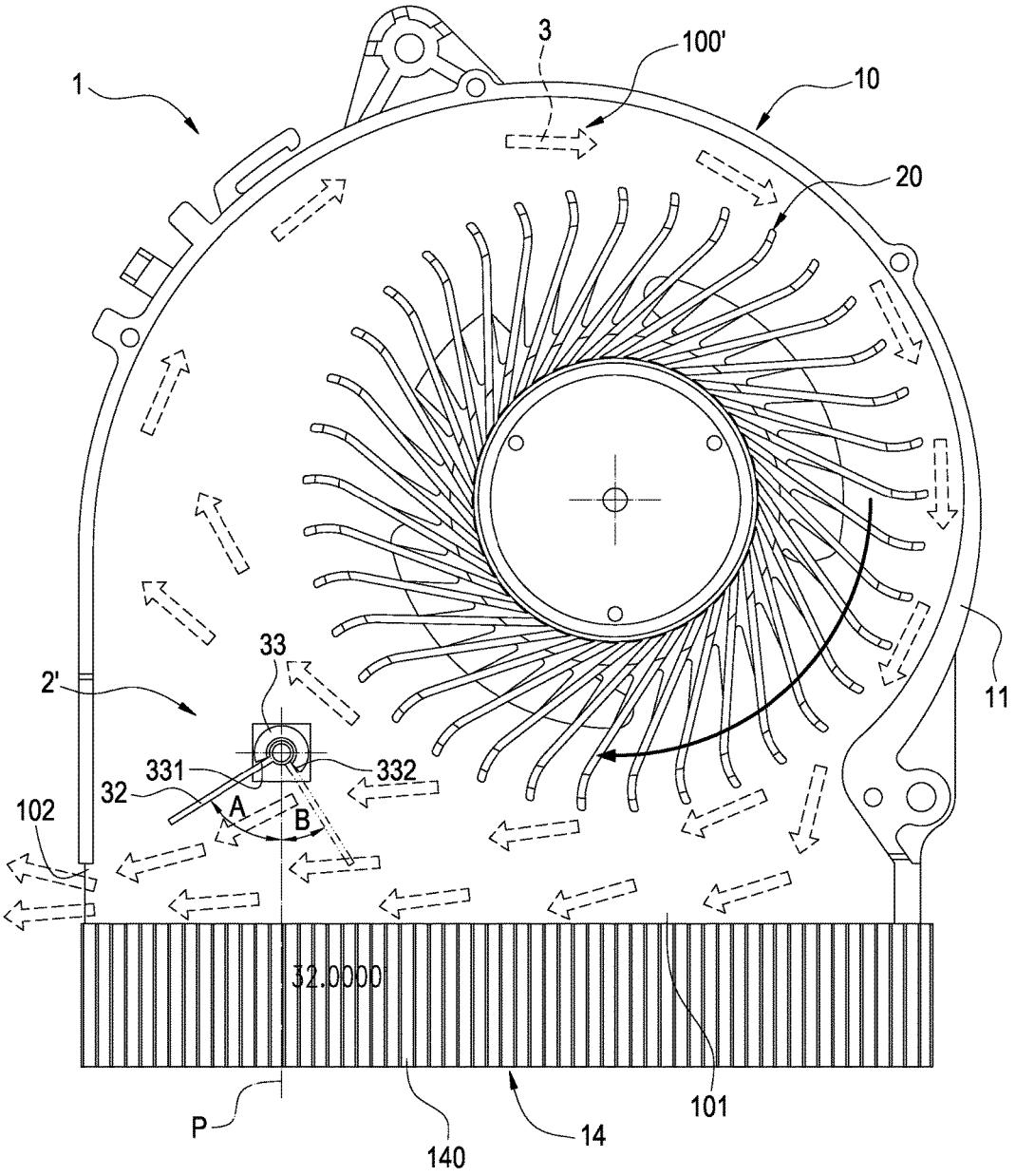
FIG. 5 is a schematic view of a cooling fan with a moving baffle in a reverse rotation status in accordance with this disclosure.

With reference to FIGS. 4 and 5 for the schematic views of a cooling fan with a moving baffle in a forward rotation status and a reverse rotation status in accordance with this disclosure respectively, the vane wheel 20 of the cooling fan 1 is controlled by a user to perform a forward rotation and a reverse rotation. In FIG. 4, the vane wheel 20 in a forward rotation (counterclockwise) status produces a cooling forced airflow 2 and forms a strong wind area 2'. In an actual implementation, the moving baffle module 30 is installed in the strong wind area 2', and the frame base 10 has the dust discharging opening 102 configured to be corresponsive to the periphery of the strong wind area 2'.

Preferably, the vane wheel 20 has a vane wheel center 200 and a vane wheel radius R. In addition, the distance from the mid-point of the shaft 31 of the moving baffle module 30 to the vane wheel center 200 is defined as a center spacing M, and the center spacing M is equal to 1~1.6 times the vane wheel radius R. In addition, the baffle 32 of the moving baffle module 30 has a rotational length L, and the rotational length L is equal to 0.2~0.6 times the vane wheel radius R 0.2~0.6. In addition, the fin module 14 has a plurality of cooling channels 140, and the baffle 32 at the stationary (not rotating) status is parallel to the cooling channels 140 and has a stationary position P. It is noteworthy that the moving baffle module 30 does not affect the flow field of the cooling forced airflow 2 produced by the vane wheel 20 in the forward rotation (counterclockwise) status.

In FIG. 5, the vane wheel 20 in the reverse rotation (clockwise) status produces a dust discharging forced airflow 3. The baffle 32 of the moving baffle module 30 is driven by the dust discharging forced airflow 3 to rotate with respect to the shaft 31. With the limitation of the limit plate 33, the baffle 32 may sway between the first lateral side 331 and the second lateral side 332 of the limit plate 33 to change the airflow distribution of the dust discharging forced airflow 3. Therefore, the dust discharging forced airflow 3 is affected by the moving baffle module 30 to discharge the dust from the dust discharging opening 102 to the outside. In this embodiment, the included angle A between the first lateral side 331 and the stationary position P is equal to 70 degrees, and the included angle B between the second lateral side 332 and the stationary position P is equal to 20 degrees. In other words, the swayable angle of the baffle 32 is approximately equal to 90 degrees under the limitation of the limit plate 33.

Figure 6:
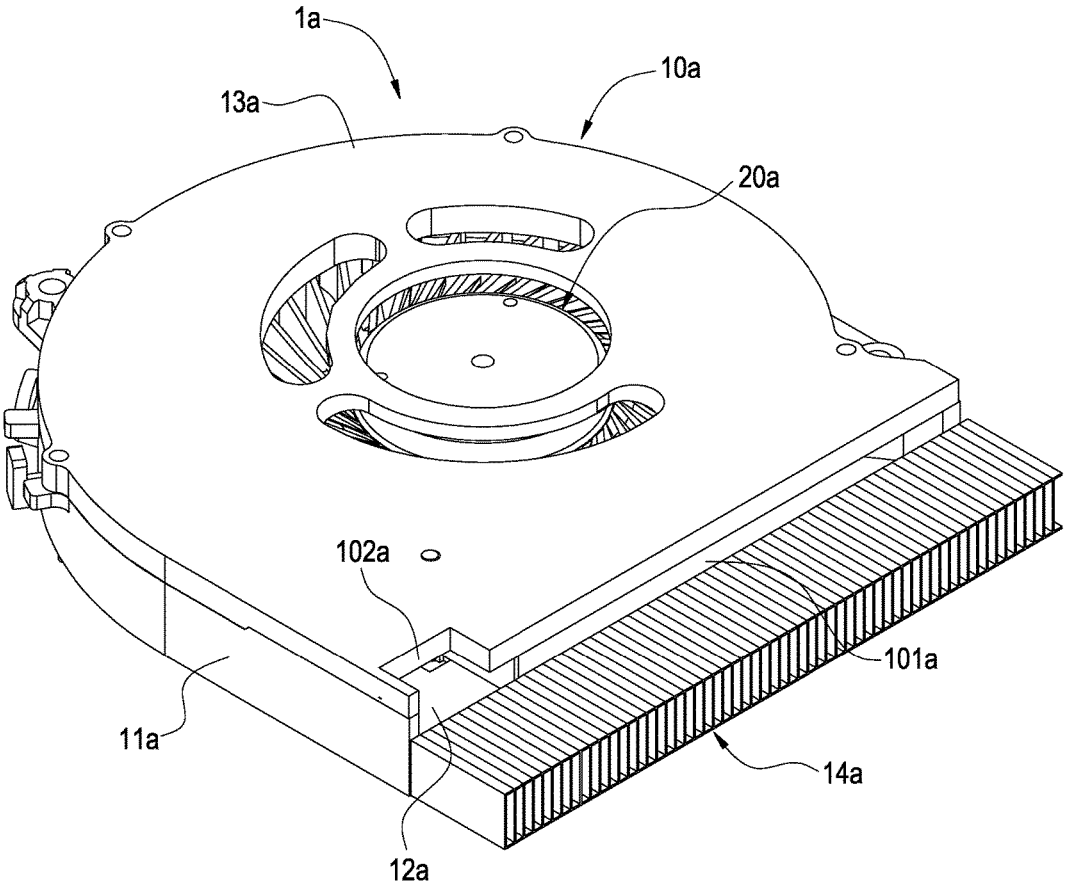
FIG. 6 is a schematic view showing a cooling fan with a moving baffle and another implementation mode of a dust discharging opening in accordance with this disclosure.
Figure 7:
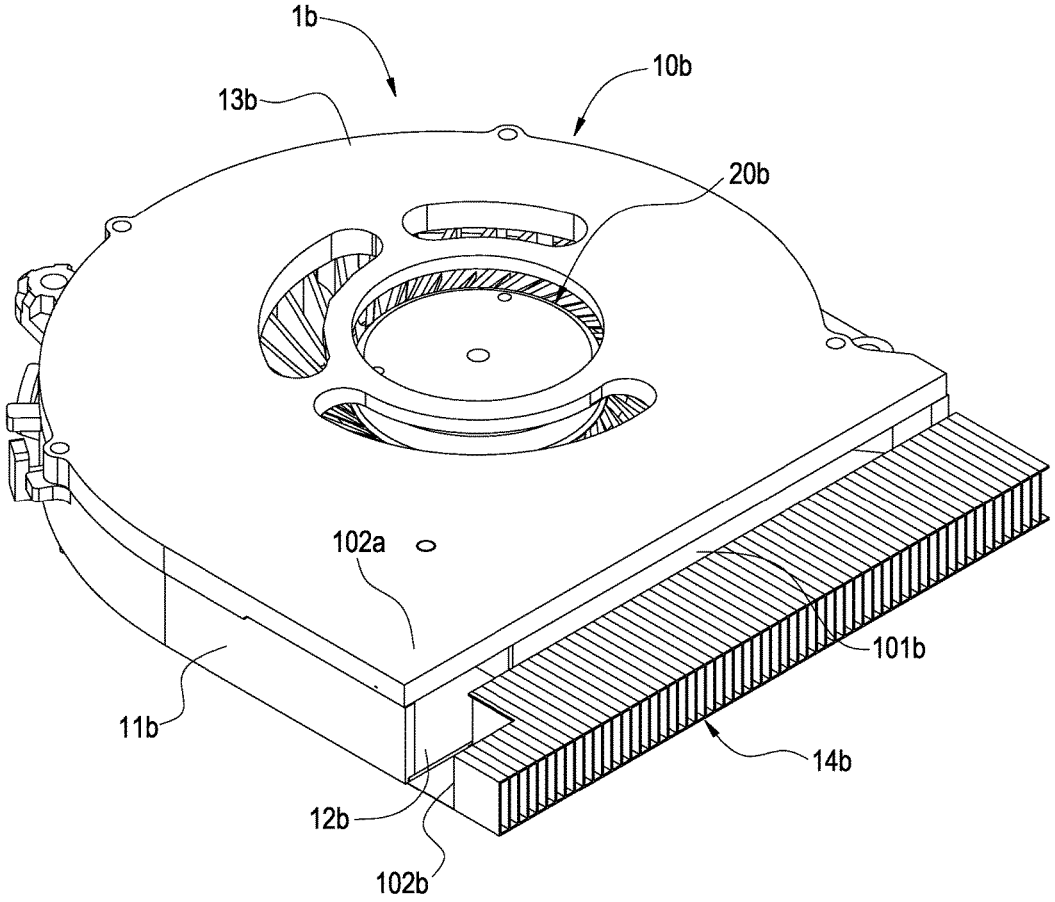
FIG. 7 is a perspective view showing a cooling fan with a moving baffle and a further implementation mode of a dust discharging opening in accordance with this disclosure.
Figure 8:
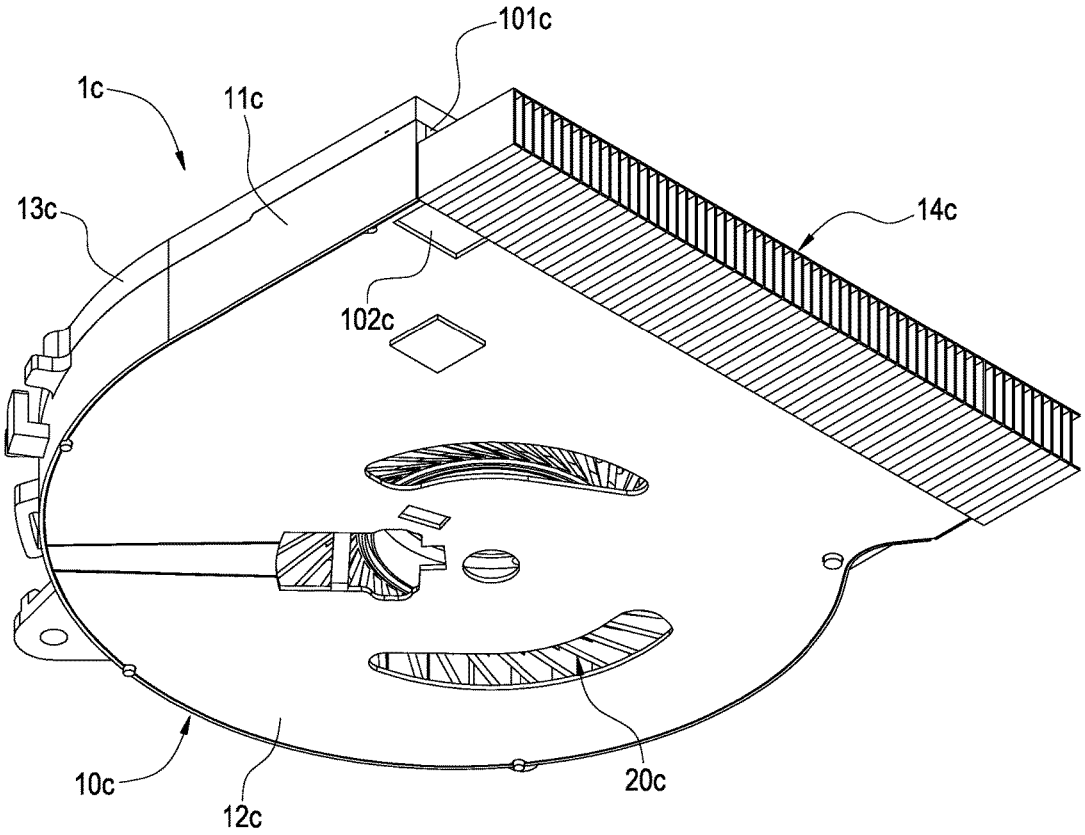
FIG. 8 is a perspective view showing a cooling fan with a moving baffle and another further implementation mode of a dust discharging opening in accordance with this disclosure.

With reference to FIGS. 6 to 8 for other implementation modes of the dust discharging opening of the cooling fan with a moving baffle in accordance with this disclosure respectively, the cooling fan 1*a* as shown in FIG. 6 comprises a frame base 10*a*, a vane wheel 20*a* and a moving baffle module (not shown in the figure). The vane wheel 20*a* and the moving baffle module are installed in the frame base 10*a* to form the cooling fan 1*a*. This embodiment is substantially the same as the first embodiment, and the cooling fan 1*a* further comprises a fin module 14*a*. An air outlet 101*a* is enclosed and formed by the frame wall 11*a*, the bottom plate 12*a* and the cover plate 13*a*, and the fin module 14*a* is installed at the air outlet 101*a*. In addition, the frame base 10*a* has a dust discharging opening 102*a* configured to be corresponsive to the periphery of the strong wind area. The difference between this embodiment and the first embodiment resides on that the dust discharging opening 102*a* is formed on the cover plate 12*a* and disposed proximate to the air outlet 101*a*.

In FIG. 7, the cooling fan 1*b* comprises a frame base 10*b*, a vane wheel 20*b* and a moving baffle module (not shown in the figure). The vane wheel 20*b* and the moving baffle module are installed in the frame base 10*b* to form the cooling fan 1*b*. This embodiment is substantially the same as the first embodiment, and the cooling fan 1*b* further comprises a fin module 14*b*. An air outlet 101*b* is enclosed and formed by the frame wall 11*b*, the bottom plate 12*b* and the cover plate 13*b*, and the fin module 14*b* is installed at the air outlet 101*b*. In addition, the frame base 10*b* has a dust discharging opening 102*b* configured to be corresponsive to the periphery of the strong wind area. The difference between this embodiment and the first embodiment resides on that the dust discharging opening 102*b* is formed at the fin module 14*b* and disposed proximate to the air outlet 101*b*.

In FIG. 8, the cooling fan 1*c* comprises a frame base 10*c*, a vane wheel 20*c* and a moving baffle module (not shown in the figure). The vane wheel 20*c* and the moving baffle module are installed in the frame base 10*c* to form the cooling fan 1*c*. This embodiment is substantially the same as the first embodiment, and the cooling fan 1*c* further comprises a fin module 14*c*. An air outlet 101*c* is enclosed and formed by the frame wall 11*c*, the bottom plate 12*c* and the cover plate 13*c*, and the fin module 14*c* is installed at the air outlet 101*c*. In addition, the frame base 10*c* has a dust discharging opening 102*c* configured to be corresponsive to the periphery of the strong wind area. The difference between this embodiment and the first embodiment resides on that the dust discharging opening 102*c* is formed at the bottom plate 12*c* and disposed proximate to the air outlet 101*c*.

While this disclosure has been described by means of specific embodiments, numerous modifications and variations could be made thereto by those skilled in the art without departing from the scope and spirit of this disclosure set forth in the claims.

What is claimed is:

1. A cooling fan with a moving baffle, provided for discharging dust in the cooling fan, the cooling fan comprising:

a frame base, including a frame wall, combined to a bottom plate and a cover plate which are disposed on upper and lower sides of the frame wall respectively, and a containing space enclosed and defined by the frame wall, the bottom plate and the cover plate;

a vane wheel, installed in the containing space and forming a flow channel with the frame wall in the containing space, and provided for producing a cooling forced airflow when the vane wheel is in a forward rotation status and forming a strong wind area, and producing a dust discharging forced airflow when the vane wheel is in a reverse rotation status;

a moving baffle module, rotatably installed in the strong wind area of the flow channel and located between the frame wall and the vane wheel, the moving baffle module comprising a shaft extending into the strong wind area in a direction away from a surface of the bottom plate extending from the frame wall to the vane wheel, a baffle axially installed to the shaft, and a limit plate installed on a side of the baffle, the limit plate having a first lateral side and a second lateral side for limiting the rotating angle of the baffle, the baffle being configured to be driven by the dust discharging forced airflow to rotate with respect to the shaft such that the baffle sways between the first lateral side and the second lateral side of the limit plate to change the airflow distribution of the dust discharging forced airflow; and a fin module, wherein an air outlet is enclosed and defined by the frame wall, the bottom plate and the cover plate, the air outlet is communicated with the containing space, and the fin module is installed at the air outlet, wherein the baffle of the moving baffle module has a fixed end axially installed to the shaft and a free end extending with respect to the shaft, and the free end of the baffle is configured to sway at a side of the fin module, and wherein the frame base has at least one dust discharging opening configured to be corresponsive to the periphery of the strong wind area, and the dust discharging forced airflow is guided by the moving baffle module to discharge the dust from the dust discharging opening to the outside;

wherein the baffle has a first side surface and a second side surface located oppositely; the cooling forced airflow is guided to the air outlet through the first side surface and the second side surface; one part of the dust discharging forced airflow flows back to a periphery of the vane wheel through the first side surface, and another part of the dust discharging forced airflow flows to the dust discharging opening through the second side surface.

2. The cooling fan with a moving baffle as claimed in claim 1, wherein the vane wheel has a vane wheel center and a vane wheel radius, and the distance from the mid-point of the shaft to the vane wheel center is defined as a center spacing, and the center spacing is equal to 1~1.6 times the vane wheel radius.

3. The cooling fan with a moving baffle as claimed in claim 1, wherein the vane wheel has a vane wheel radius, and the baffle has a rotational length, and the rotational length of the baffle is equal to 0.2~0.6 times the vane wheel radius.

4. The cooling fan with a moving baffle as claimed in claim 1, wherein the limit plate is a C-shaped ring, and the limit plate is combined with the shaft and the bottom of the baffle.

5. The cooling fan with a moving baffle as claimed in claim 1, wherein the fin module has a plurality of cooling channels, and the baffle is parallel to the cooling channels in a stationary status and has a stationary position, and the included angle formed between the first lateral side and the stationary position is equal to 70 degrees, and the included angle formed between the second lateral side and the stationary position is equal to 20 degrees.

6. The cooling fan with a moving baffle as claimed in claim 1, wherein the dust discharging opening is formed on the frame wall and disposed closer to an external surface containing the air outlet than to an external surface opposite to the external surface containing the air outlet.

7. The cooling fan with a moving baffle as claimed in claim 1, wherein the dust discharging opening is formed on the cover plate and disposed closer to an external surface containing the air outlet than to an external surface opposite to the external surface containing the air outlet.

8. The cooling fan with a moving baffle as claimed in claim 1, wherein the dust discharging opening is formed on the fin module and disposed closer to an external surface containing the air outlet than to an external surface opposite to the external surface containing the air outlet.

9. The cooling fan with a moving baffle as claimed in claim 1, wherein the dust discharging opening is formed on the bottom plate and disposed closer to an external surface containing the air outlet than to an external surface opposite to the external surface containing the air outlet.

* * * * *